US008283008B2

(12) United States Patent
Lutzig et al.

(10) Patent No.: US 8,283,008 B2
(45) Date of Patent: Oct. 9, 2012

(54) CONTAINER WITH TACTILE SURFACE

(75) Inventors: Bodo-Werner Lutzig, Chavornay (CH); Zsolt Igo, Pully (CH)

(73) Assignee: Philip Morris USA Inc., Richmond, VA (US)

( * ) Notice: Subject to any disclaimer, the term of this patent is extended or adjusted under 35 U.S.C. 154(b) by 421 days.

(21) Appl. No.: 12/538,615

(22) Filed: Aug. 10, 2009

(65) Prior Publication Data

US 2010/0032324 A1 Feb. 11, 2010

(51) Int. Cl.
*B32B 1/02* (2006.01)
*B32B 1/08* (2006.01)

(52) U.S. Cl. ..... 428/35.7; 428/34.1; 428/34.2; 428/35.9; 428/36.9

(58) Field of Classification Search ..... 428/34.1, 428/34.2, 35.7, 35.9, 36.9
See application file for complete search history.

(56) References Cited

U.S. PATENT DOCUMENTS

| | | | | |
|---|---|---|---|---|
| 3,524,583 | A | 8/1970 | Gregory | |
| 4,714,082 | A | 12/1987 | Banerjee et al. | |
| 5,692,525 | A | 12/1997 | Counts et al. | |
| 5,855,315 | A * | 1/1999 | Roseth | 229/120.04 |
| 6,919,111 | B2 | 7/2005 | Swoboda et al. | |
| 2003/0152724 | A1 | 8/2003 | Swoboda et al. | |
| 2004/0209023 | A1 * | 10/2004 | Swoboda et al. | 428/34.2 |
| 2005/0084185 | A1 | 4/2005 | Moon | |
| 2005/0112305 | A1 | 5/2005 | Swoboda et al. | |
| 2011/0000802 | A1 | 1/2011 | Weiss et al. | |

FOREIGN PATENT DOCUMENTS

| | | | |
|---|---|---|---|
| DE | 4111833 | A1 | 10/1992 |
| WO | WO 00/03934 | A1 | 1/2000 |
| WO | WO 01/23263 | A1 | 4/2001 |
| WO | WO 02/48007 | A1 | 6/2002 |

OTHER PUBLICATIONS

International Preliminary Report on Patentability mailed Feb. 24, 2011 for International Application No. PCT/EP2009/005502.
European Search Report dated Dec. 16, 2008 for European Patent Application No. EP 08252667.
U.S. Appl. No. 12/828,965, filed Jul. 1, 2010.

* cited by examiner

*Primary Examiner* — Marc Patterson
(74) *Attorney, Agent, or Firm* — Buchanan Ingersoll & Rooney PC

(57) ABSTRACT

A container having a surface including at least one high friction surface region having a coefficient of friction of between about 0.63 and about 2. Optionally, the at least one high friction surface region includes a coating layer, which may include fibers. The surface of the container may further include at least one low friction surface region having a coefficient of friction of less than 0.5, or preferably less than 0.3.

7 Claims, 2 Drawing Sheets

CONTAINER WITH TACTILE SURFACE

CROSS-REFERENCE TO RELATED APPLICATION

This application corresponds to European Application No. 08252667.4, filed Aug. 11, 2008, the entire content of which is incorporated herein by this reference thereto.

BACKGROUND

A container having a novel surface texture is provided. The container is particularly suitable to house elongate smoking articles, such as for example, cigarettes.

It is known to package elongate smoking articles and other consumer goods in containers formed from folded laminar blanks. The laminar blanks may be made from any suitable sheet material, such as for example cardboard, metal or plastic. Graphics and text are typically applied to the surfaces of the containers, in order to communicate information to the consumer, such as brand, advertising, promotional or product information.

Typically, it is desired to form containers from sheet materials having surfaces which are as smooth as possible. This is so that the friction between the sheet material and the surfaces of the manufacturing machinery in direct contact with the sheet material can be minimised in order to maximise machine speed and efficiency.

It would be desirable to provide a novel container which has a surface including at least one surface region having a novel texture and appearance. It would further be desirable if such a container could be formed using known and available machinery and methods, without the need for significant modifications.

SUMMARY OF SELECTED ASPECTS OF THE INVENTION

A container wherein a surface of the container includes at least one high friction surface region having a coefficient of friction of between about 0.63 and about 2 is provided. Preferably, the at least one high friction surface region has a coefficient of between about 1 and about 2. In an embodiment, the surface of the container further includes at least one low friction surface region having a coefficient of friction of less than 0.5, preferably less than 0.3. Preferably, the container includes a repetitive or non-repetitive pattern of high friction surface regions having a coefficient of friction of greater than 0.63. Preferably, the container is a smoking article container.

In one embodiment, the at least one high friction surface region of the surface includes a coating layer. The coating layer can include fibers. The fibers account for between about 10 percent and about 30 percent of the total weight of the sheet material in the high friction surface region. In one embodiment, the coating layer is formed from a rubberized material. The rubberized material accounts for between about 0.5 percent and about 3.0 percent of the total weight of the sheet material in the high friction surface region. In another embodiment, the coating layer of the at least one high friction surface region is printed onto the surface of the container. The coating layer is at least partially covered by a second coating. The second coating has a coefficient of friction of less than 0.3, preferably less than 0.15.

A laminar blank for forming containers is also provided. The laminar blank includes at least one high friction surface region on the surface thereof having a coefficient of friction of between about 0.63 and about 2.

DETAILED DESCRIPTION

Figure 1:
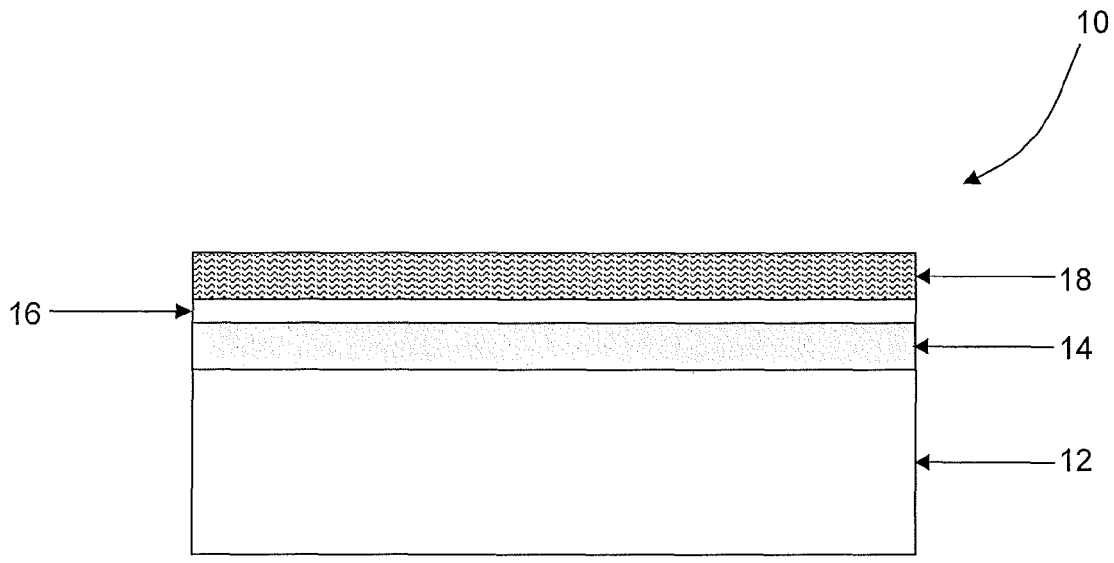
FIG. 1 shows a cross section of a first embodiment of a sheet material including a high friction surface region suitable for forming a container according to the present invention.

A container, wherein the surface of the container includes at least one surface region having a coefficient of friction of between about 0.63 and about 2, is provided. The at least one surface region having a coefficient of friction of between about 0.63 and about 2 will be referred to throughout the specification as the at least one "high friction surface region". Alternatively or in addition, the high friction surface region has a coefficient of friction of greater than about 0.70, greater than about 0.75, greater than about 0.80, greater than about 0.85, greater than about 0.90 or greater than about 0.95. The higher the coefficient of friction of the high friction surface region, the more pronounced is the tactile sensation associated with the container.

As used herein, the term "container" refers to the packaging of consumer goods, such as for example smoking articles. It is intended to encompass the outer packaging, or housing, as well as any inner packaging which may only become visible when the container is open, such as for example the inner frame of a hinge lid box.

The term "coefficient of friction" is used throughout the specification to refer to the static coefficient of friction ($\mu$) between the surface of the high friction surface region of containers according to the invention and another, substantially identical surface. In other words, the coefficient of friction referred to is that of the surface of the high friction surface region with itself. The static friction coefficient ($\mu$) between two solid surfaces is defined as the ratio of the tangential force (F) required to produce sliding divided by the normal force between the surfaces (N):

$$\mu = F/N$$

The coefficient of friction between two surfaces is measured experimentally, for example by the horizontal plane method according to ISO standard ISO 15359:1999.

Typically, the coefficient of friction of a standard card material for making containers for smoking articles, such as cigarette packs, is between about 0.20 and about 0.30. The coefficient of friction of the high friction surface region of the surface of containers according to the invention is therefore at least about two to three times greater than for standard cigarettes packs. The high coefficient of friction gives the high friction surface region of the surface a texture which is very different to that of conventional paper or cardboard packs and provides the consumer with a unique tactile experience.

Preferably, the coefficient of friction of the at least one high friction region is between about 1 and about 2, more preferably, between about 1 and about 1.5.

Typically, the at least one high friction surface region will be provided on the external surface of containers. However, in addition or alternatively, at least one high friction surface region may be provided on the internal surfaces of containers, which only become accessible when the container is opened.

The at least one high friction surface region may cover substantially the entire external surface of the container. Alternatively, the at least one high friction surface region may cover only a part of the external surface. Preferably, where the high friction surface region covers only a part of the external surface, the remainder of the surface has a coefficient of friction of less than about 0.5. This provides an interesting textural contrast to the at least one high friction surface region.

Preferably, the high friction surface region integrates with additional print or other embellishment on the pack. Alternatively or in addition, the high friction surface region has the shape of a logo, image, brand name or the like. Alternatively or in addition, the container according to the invention includes a repetitive or non-repetitive pattern of high friction surface regions. Examples of repetitive patterns are geometrical shapes like triangles, stripes, squares, rectangles, chevrons, circles, semicircles, ovals, stars, diamonds, type font, checkerboard patterns, brick wall patterns and the like. Examples of non-repetitive patterns are tyre patterns, animal skin patterns like zebra, tiger, leopard, cheetah, snake or crocodile skin patterns, wave patterns, fingerprint patterns, cloud patterns, smoke patterns or cut wood patterns. A non-repetitive pattern may be such that it creates the impression of a gradient in friction, for example by patches of high friction surface regions becoming larger and denser in a particular direction.

Preferably, the at least one high friction surface region is provided by a coating layer on the surface of the sheet material used to form the container. For example, the high friction surface region may be provided by a coating layer formed of fibers, such as flock or rayon viscose fibers, which give a soft, "peach skin" texture. The fibers may be deposited onto a layer of a suitable adhesive. Preferably, the layer of fibers account for between about 10 percent and about 30 percent of the total weight of the sheet material in the high friction surface region.

In another example, the high friction surface region is provided by a coating which gives the surface region a rubberized texture, such that it feels sticky to the touch. Preferably, the surface coating material used to produce a rubberized texture is polyurethane. Preferably, the rubberized coating accounts for between about 0.5 percent and about 3.0 percent of the total weight of the sheet material in the cross section of the high friction surface region.

In another example, small particles are adhered to the surface that bestow the high friction surface region with a rough, jagged, sand paper like surface. Preferably, the small particles are covered by a layer of varnish to adhere them to the surface.

Alternatively, the surface structure of the blank that is used to form the container is processed to increase the coefficient of friction, for example by roughening the surface by brushing or by embossing the high friction surface region with a number of small grooves, pyramids or other micro surface structures.

Alternatively, the coefficient of friction of the surface structure of the blank may be increased by the inclusion of particularly long and stiff fibers inside the material where cardboard is used as a material. Additionally, plastic or metal material may be for example electrically activated, chemically activated, sandblasted or a combination thereof.

The sheet material used to form the containers of the present invention is preferably a paper or cardboard material. Preferably, a pre-coating, or primer layer is applied to the paper or cardboard base layer before applying the coating layer in the high friction surface region. Such a primer layer may be required, for example, to improve the visibility of the printing applied on top of the surface of the high friction surface region. Preferably, the primer layer is used where the high friction surface region is a dark colored, rubberized high friction surface region. The primer layer advantageously improves the bonding between the different layers of rubberized coatings and inks.

Preferably, the coating layer of the at least one high friction surface region is printed onto the surface of the container. This allows for a high resolution of the high friction surface region, particularly, if a pattern of high friction surface regions is applied to the container.

The coating layer of the high friction surface region may be overprinted, embossed, debossed or otherwise processed in order to alter the final appearance and texture of the high friction surface region. Debossing and embossing may further increase the coefficient of friction of the container. Where the coating layer of the high friction surface region is printed, the printing preferably has a high abrasion resistance. This prevents the print being rubbed off by the higher friction between the high friction surface region and the surfaces of the machine parts with which the high friction surface region comes into direct contact during manufacture of the container.

A high friction surface region may be partially covered by a layer of smooth lacquer or other material with a very low coefficient of friction, for example between about 0.05 and about 0.15. This smooth lacquer may be applied in a repetitive or non-repetitive pattern as described above. The combination of a high friction surface region and a very low friction surface creates a particularly interesting tactile sensation.

The containers may be rigid or "hard" packs. For example, containers may be hinge-lid containers, of the type commonly used to package cigarettes and cigars. Such hinge-lid containers include a box portion and a lid portion connected to the box portion along a hinge line extending across the rear wall of the container. One or both of the box portion and the lid portion may include at least one high friction surface region. Alternatively, containers may be "slide and shell" containers having an inner slider slideably mounted within an outer shell. One or both of the inner slider and the outer shell may include at least one high friction surface region.

A high friction surface region located at an area of the container that comes into contact with another area of the container during the opening and closing movement of the container increases the required force to open or close the container. Such particular high friction surface regions that increase the friction upon opening or closing of the container are for example, in a slide and shell container, the outer surfaces of the inner slider or the inner surface of the outer shell. Other examples of such particular high friction surface regions that increase the friction upon opening or closing of the container are, in a hinge lid pack, the outer side of the inner frame and the inner side of the lid. This increase of friction between the movable parts of the pack advantageously avoids the inadvertent opening of the pack. Additionally, the increased resistance to an opening or closing movement improves the quality feeling of the container, for example due to the soft deceleration of the closing movement caused by the friction.

Alternatively, containers may be "soft" packs or rigid soft packs for smoking articles such as cigarettes. In this context, the term "soft" pack refers to a pack including a cup shaped box containing a wrapped bundle of smoking articles. Where the cup is formed from a rigid material, the "soft" pack is referred to as rigid soft pack. Alternatively, the container is a pouch, such as those commonly used for loose tobacco.

The exterior surfaces of containers may be printed, embossed, debossed or otherwise embellished with manufacturer or brand logos, trade marks, slogans and other consumer information and indicia. Alternatively, or in addition, the exterior surfaces of containers may be at least partially covered with lacquer, metallisation, holograms, luminescent material, or any other materials that alter the feel, odour or appearance of the container.

Containers may be used to house any kind of consumer goods. The containers find particular application as packs for elongate smoking articles such as, for example, cigarettes, cigars or cigarillos. It will be appreciated that through appropriate choices of the dimensions thereof, containers may be designed for different numbers of conventional size, king size, super-king size, slim or super-slim cigarettes.

Through an appropriate choice of the dimensions thereof, containers may also be designed to hold different total numbers of smoking articles, or different arrangements of smoking articles. For example, through an appropriate choice of the dimensions thereof, containers may be designed to hold a total of ten, fifteen, sixteen, seventeen, eighteen, nineteen, twenty, twenty-one or twenty five smoking articles. These may be arranged in different collations, depending on the total number of smoking articles. For example, the smoking articles may be arranged in one row of six, seven, eight, nine or ten; two rows of five, six, seven, eight, nine or ten; two rows of 5-6, 6-7, 7-8; three rows of 5-5-5, 5-6-5, 6-5-6, 5-6-7, 6-7-6, 7-5-7, 7-6-7, 7-7-7, 8-9-8; four rows of four, five or six.

Once filled, containers may be shrink wrapped or otherwise over wrapped with a transparent polymeric film of, for example, polyethylene or polypropylene, in a conventional manner. Where containers are over wrapped, the over wrapper may include a tear tape. The over wrapper may be provided with one or more opening cuts to ease removal of the wrapper from the container, in particular from the high friction surface regions of the surface of the container.

Containers may have one or more right-angled longitudinal edges, one or more right-angled transverse edges, one or more rounded longitudinal edges, one or more rounded transverse edges, one or more bevelled longitudinal edges, one or more bevelled transverse edges, or any suitable combination thereof.

Containers including at least one high friction surface region on the surface may be formed from laminar blanks using standard machinery for forming cigarette packs which has preferably been modified to take into account the effect of the high coefficient of friction of the high frictions surface regions of the containers according to the invention.

The high coefficient of friction results in higher levels of friction between the high friction surface regions and the machinery surfaces compared to the levels of friction during manufacture of conventional packs. In order to compensate for the high friction coefficient of at least surface regions of the surface of the laminar blanks, the surfaces of the machine parts coming directly into contact with the high friction surface regions of the laminar blanks are preferably as smooth as possible. Preferably, these machinery parts are coated with friction reducing materials such as for example polytetrafluorethylene (PTFE).

Additionally, or alternatively, the conveyor belts used in machinery for forming containers are preferably formed of a softer material than conventional conveyor belts to prevent ink smearing from the pack during transport.

Additionally, or alternatively, the dimensions or design of the blank folding unit of standard machinery may be altered in order to improve forming of the containers. The contact surface between the blank and the folding units may be advantageously reduced by changing flat surfaces of the folding unit to profiled smooth surfaces. This advantageously reduces the area of contact between the blank and the machinery, reducing wear of both the blank and the machinery. Also, this will prevent ink printed on the blank from smearing. Alternatively or in addition, by increasing the distance between a folding unit and the blank, for example by between about 0.10 mm and about 0.30 mm compared to conventional machinery, the tension and pressure between the blank and the folding unit is reduced. This further prevents ink from smearing and improves the correct positioning of the fold lines. Alternatively or in addition, the dimensions of the pocket may be increased into which a pack is inserted during the over wrapping process. For example, the cross section of the pocket may be increased by between about 0.2 mm and about 0.6 mm. Alternatively or in addition, the overall machine speed may be reduced to reduce the friction forces between blank and machinery.

The containers are further described, by way of example only, with reference to the accompanying drawings.

The sheet material 10 shown in FIG. 1 includes a lower base layer 12 of cardboard material, a coating layer 14 on the upper surface of the base layer 12, an adhesive layer 16 on the coating layer 14 and an upper layer 18 of viscose rayon fibers. Additionally, one or several layers of print may be applied onto the fiber layer 18 (not shown). The upper layer 18 of viscose rayon fibers is adhered to the sheet material by means of the adhesive layer 16 and accounts for about 12 percent by weight of the sheet material 10. The adhesive layer 16 accounts for about 25 percent of the total weight, while the coating layer 14 accounts for about 3 percent thereof.

Containers may be formed entirely from the sheet material 10 shown in FIG. 1. Alternatively, containers may be formed from a sheet material including the lower base cardboard layer 12 and the coating layer 14 and having one or more high friction surface regions in which the adhesive layer 16 and the fiber layer 18 have been applied over the coating layer 14, as shown in the cross section of FIG. 1.

Figure 2:
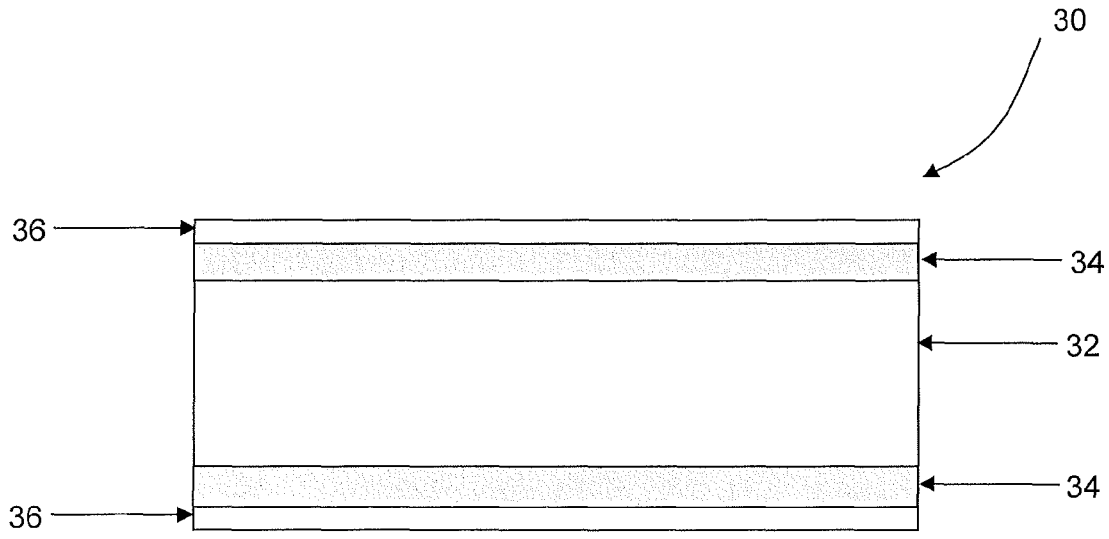
FIG. 2 shows a cross section of a second embodiment of a sheet material including a high friction surface region suitable for forming a container according to the present invention.

The sheet material 30 shown in FIG. 2 includes a base layer of cardboard material 32, a pre-coating layer 34 on each of the surfaces of the cardboard layer 32 and an outer coating layer 36 on each of the pre-coating layers. The pre-coating layers 34 are formed of a colored resin that includes dies or pigments The outer coating layers 36 are formed of polyurethane which gives the surfaces of the sheet material 30 a rubberized texture. Each outer coating layer 36 accounts for between about 0.5 percent and about 3.0 percent of the total weight of the sheet material 30, while each pre-coating layer accounts for between about 3.5 percent and about 5.5 percent thereof.

Figure 3:
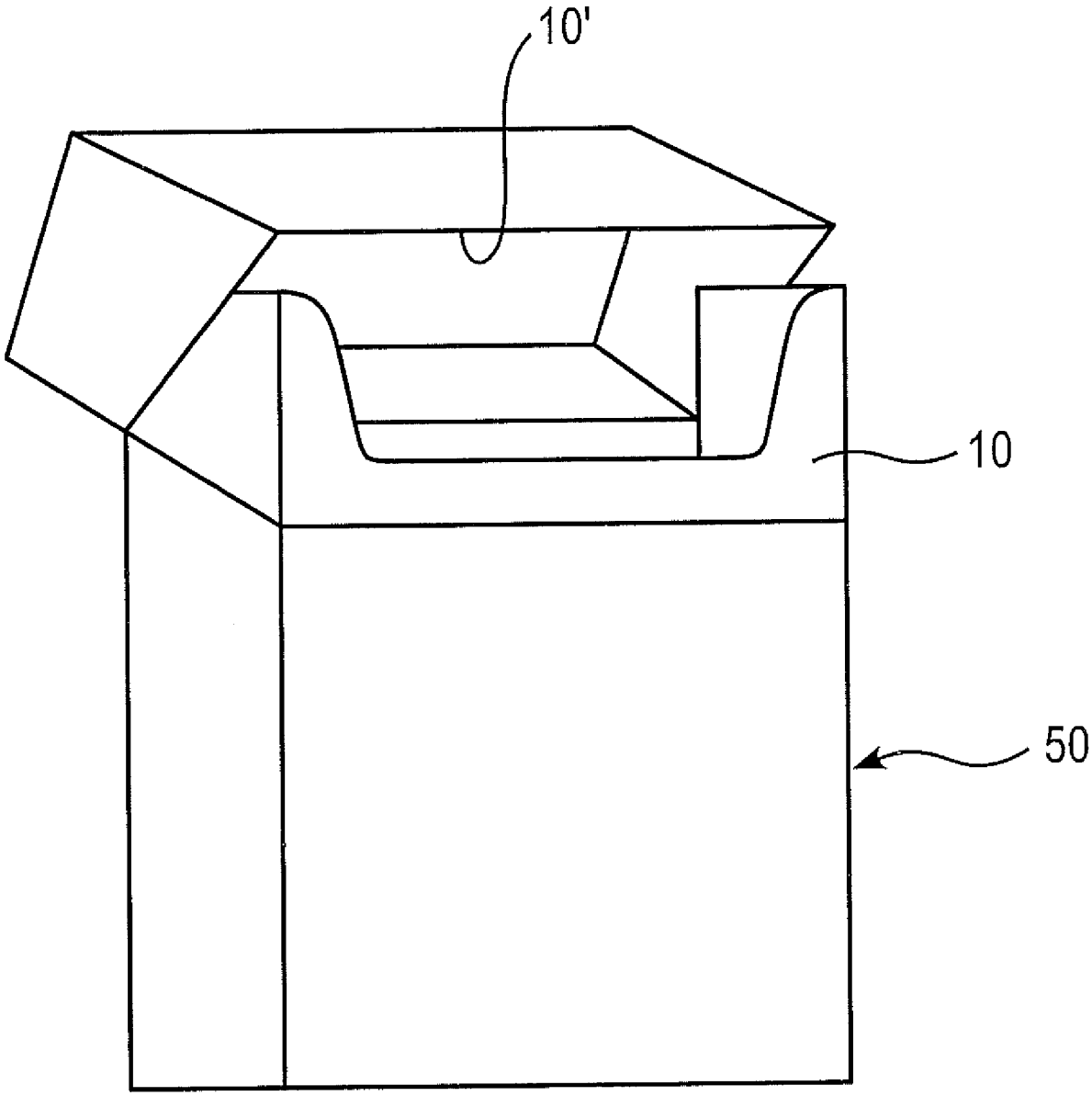
FIG. 3 is a schematic perspective of a container.

FIG. 3 is a schematic perspective view of a container 50 formed of a sheet material, such as the sheet materials 10, 30 (also shown in FIGS. 1 and 2). The container 50 can be a cigarette container. Preferably, the container 50 has a generally rectangular structure, and is sized and configured to contain smoking articles, such as cigarettes. Also preferably, the container 50 includes at least one high friction surface region having a coefficient of friction of between about 0.63 and 2. In an embodiment, the container 50 can be a hinged-lid pack. As shown, the inner surface of the hinged-lid pack 50 and the inner surface of the lid may be formed of the sheet material 10, 10'.

In this specification, the word "about" is often used in connection with numerical values to indicate that mathematical precision of such values is not intended. Accordingly, it is intended that where "about" is used with a numerical value, a tolerance of ±10% is contemplated for that numerical value.

While the foregoing describes in detail a preferred container with a tactile surface and methods of making with reference to a specific embodiment thereof, it will be apparent to one skilled in the art that various changes and modifications may be made to the container and equivalents method may be employed, which do not materially depart from the spirit and scope of the invention. Accordingly, all such changes, modifications, and equivalents that fall within the spirit and scope of the invention as defined by the appended claims are intended to be encompassed thereby.

We claim:

1. A container comprising:

a rectangular body having an outer surface; and a hinged lid having an inner surface, the hinged lid being attached to the rectangular body so as to be movable between opened and closed positions;

wherein the rectangular body and the hinged lid are formed of a sheet material and wherein the outer surface of the rectangular body and/or the inner surface of the hinged lid comprise at least one high friction surface region having a coefficient of friction of between about 0.63 and about 2 such that the at least one high friction surface region increases friction between the rectangular body and the hinged lid so as to substantially prevent inadvertent opening of the container, wherein the at least one high friction surface region comprises a coating and the coating comprises fibers accounting for about 10 percent to about 30 percent of the total weight of the sheet material in the high friction surface region.

2. The container according to claim 1, wherein the at least one high friction surface region has a coefficient of friction of between about 1 and about 2.

3. The container according to claim 1, wherein the outer surface of the rectangular body and/or the inner surface of the hinged lid further comprises at least one low friction surface region having a coefficient of friction of 0.3 to less than 0.5.

4. The container according claim 1 wherein, the container comprises a repetitive or non-repetitive pattern of high friction surface regions having a coefficient of friction of greater than 0.63.

5. The container according to claim 1, wherein the coating of the at least one high friction surface region is printed onto the outer surface of the rectangular body and/or the inner surface of the hinged lid.

6. The container according to claim 1, wherein the coating is at least partially covered by a second coating, wherein the second coating has a coefficient of friction of 0.15 to less than 0.3.

7. The container according to claim 1, wherein the container is a smoking article container.

* * * * *